US007188643B1

(12) United States Patent
Lile

(10) Patent No.: US 7,188,643 B1
(45) Date of Patent: Mar. 13, 2007

(54) TWIN TIE WRENCH FOR INSTALLING FENCE MOUNTING CLIPS AROUND FENCING WIRE TO SECURE FENCING WIRE TO A T-POST AND/OR AN ELECTRICAL POST

(76) Inventor: Kenneth H. Lile, 8010 W. Hwy. 22, Barry, TX (US) 75102

( * ) Notice: Subject to any disclaimer, the term of this patent is extended or adjusted under 35 U.S.C. 154(b) by 0 days.

(21) Appl. No.: 11/496,222

(22) Filed: Jul. 31, 2006

Related U.S. Application Data

(63) Continuation-in-part of application No. 11/288,998, filed on Nov. 29, 2005.

(51) Int. Cl.
*B21F 7/00* (2006.01)
*B21F 33/00* (2006.01)
*B25F 1/00* (2006.01)

(52) U.S. Cl. ..... 140/117; 140/57; 7/117

(58) Field of Classification Search ..... 140/149, 140/93.6, 93 R, 102.5, 104, 106, 117–118, 140/123–124, 57; 7/117
See application file for complete search history.

(56) References Cited

U.S. PATENT DOCUMENTS

| | | | |
|---|---|---|---|
| 542,827 | A | 7/1895 | Horst |
| 577,861 | A | 3/1897 | Kirby |
| 942,732 | A | 12/1909 | Morford |
| 1,286,488 | A | 12/1918 | Amberg |
| 3,613,745 | A | 10/1971 | Treiber |
| 4,270,581 | A | 6/1981 | Claxton et al. |
| 4,917,154 | A | 4/1990 | Roberson, Sr. |
| D368,006 | S | 3/1996 | Aldrich |
| 5,518,044 | A | 5/1996 | Ferguson |
| 5,649,572 | A | 7/1997 | Lile |
| 5,778,472 | A | 7/1998 | Lang |
| 5,909,910 | A | 6/1999 | Shaffer |
| 6,499,514 | B1 | 12/2002 | Hodge, Sr. |

*Primary Examiner*—Lowell A. Larson
*Assistant Examiner*—Teresa M. Bonk
(74) *Attorney, Agent, or Firm*—Bracewell & Giuliani LLP

(57) ABSTRACT

A tie wrench for bending mounting clips to secure a fence wire to a fence post is disclosed. The tie wrench utilizes two different hooks that are positioned to engage mounting clips and fence wire. The tie wrench is pulled toward the user to twist and secure the outer portion of the clip and the fence wire to the fence post. The other side of the clip is engaged and deformed in a similar manner by the hooks that protrude from the blade body of the tool. The large bend in the blade coupled with the small recess adjacent the exterior corner of the device seats the fence wire.

15 Claims, 10 Drawing Sheets

TWIN TIE WRENCH FOR INSTALLING FENCE MOUNTING CLIPS AROUND FENCING WIRE TO SECURE FENCING WIRE TO A T-POST AND/OR AN ELECTRICAL POST

The present application is a continuation-in-part (CIP) of U.S. patent application Ser. No. 11/288,998, filed on Nov. 29, 2005, and is incorporated herein by reference.

BACKGROUND OF THE INVENTION

1. Technical Field

The present invention relates in general to an improved fencing tool and, in particular, to an improved system, method, and apparatus for bending both ends of wire fence mounting clips around fencing to secure the wire fence to different types of fence posts.

2. Description of the Related Art

Farmers and ranchers frequently utilize metal fence posts and insulated electrical fence posts to erect various types of fencing. Some of the more common types of fencing include single strand, woven wire, and barbed wire fences, and are hereinafter referred to as "wire" fences. Maintaining fences in good condition requires almost continuous inspection and repair. Livestock, wild life, and weather elements continually work to loosen and break down fences. Thus, many farmers and ranchers are required to inspect and repair existing fences on a frequent basis.

Wire fences are typically attached to a metal or insulated fence post by the use of wire mounting clips. Mounting clips are short, pre-formed or bent pieces of wire that are designed to initially fit loosely around a fence post and the wire fencing to be secured to the fence post. After the mounting clip is in position, it must be further deformed to retain the fence wire on the fence post. Each mounting clip has a V-shaped central portion that receives the fence post, and opposing curled ends that pass around the fence wire on both sides of the fence post for fastening the fence wire to the fence post.

Mounting clips may be used to either initially erect a fence or to repair a fence that requires mending. Farmers and ranchers typically use a pair of pliers, a screwdriver, or other common hand tools to install and/or remove the mounting clips from the fence posts. However, using commonplace tools to tightly and securely fasten mounting clips to fence posts requires considerable effort. This is particularly true for the deformation of both sides of mounting clips.

In the prior art, there have been a number of attempts to develop hand tools for attaching fencing mounting clips. Some designs use a pivot hook with webs and recesses for grasping the clips. However, these designs have flat and wide blades that are cumbersome to use in the narrow spaces between the clips and the fence post. Other designs use hooked blades that pivot about a fence wire to wrap the outer portion of a mounting clip around the fence wire. However, those designs require perpendicular insertion of the wire completely through the blade to effect the wrap. Still other prior art designs bend clips or wire, but they do not engage the fence wire to do so. Thus, it would be desirable to have an improved fencing tool for use in wire fence installation, particularly to quickly and easily facilitate the attachment of a fence wire to a fence post with a mounting clip.

SUMMARY OF THE INVENTION

One embodiment of a system, method, and apparatus of a fencing tool of the present invention is used to mount a metal fence wire about a metal or insulated fence post using metal fence mounting clips. The fence post may comprise a T-post or square-shaped electrical fence post. One face of the post has a plurality of longitudinally extending nubs on an exterior surface thereof for supporting fence wire that is attached thereto. The mounting clip has a central portion that terminates in a pair of oppositely extending ends or loops. The central portion is received about the rear of the fence post and the oppositely extending loops pass over and about the fence wire on both sides of the fence post. Portions of the fencing tool act as a cam surface that engages and cooperate with the fence wire for applying a bending force to the mounting clip being mounted.

The present invention acts as a wrench for bending wire clips to secure a fence wire to a fence post. The tie wrench utilizes a hook that is positioned beneath the fence wire but above an outer portion of the mounting clip. The tie wrench is then pulled toward the user to twist the outer portion of the mounting clip into a position that secures one side of the mounting clip and the fence wire to the fence post. The other side of the mounting clip is engaged and deformed in a similar manner by a hook or flared finger that protrudes from the blade body of the tool. The hook or flared finger seats the end of the mounting clip. The large bend in the blade coupled with the small recess adjacent the exterior corner of the device seats the fence wire and makes the fencing tool easier and quicker to use compared to prior art devices.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the invention, as well as others which will become apparent are attained and can be understood in more detail, more particular description of the invention briefly summarized above may be had by reference to the embodiment thereof which is illustrated in the appended drawings, which drawings form a part of this specification. It is to be noted, however, that the drawings illustrate only an embodiment of the invention and therefore are not to be considered limiting of its scope as the invention may admit to other equally effective embodiments.

DETAILED DESCRIPTION OF THE INVENTION

Figure 1:
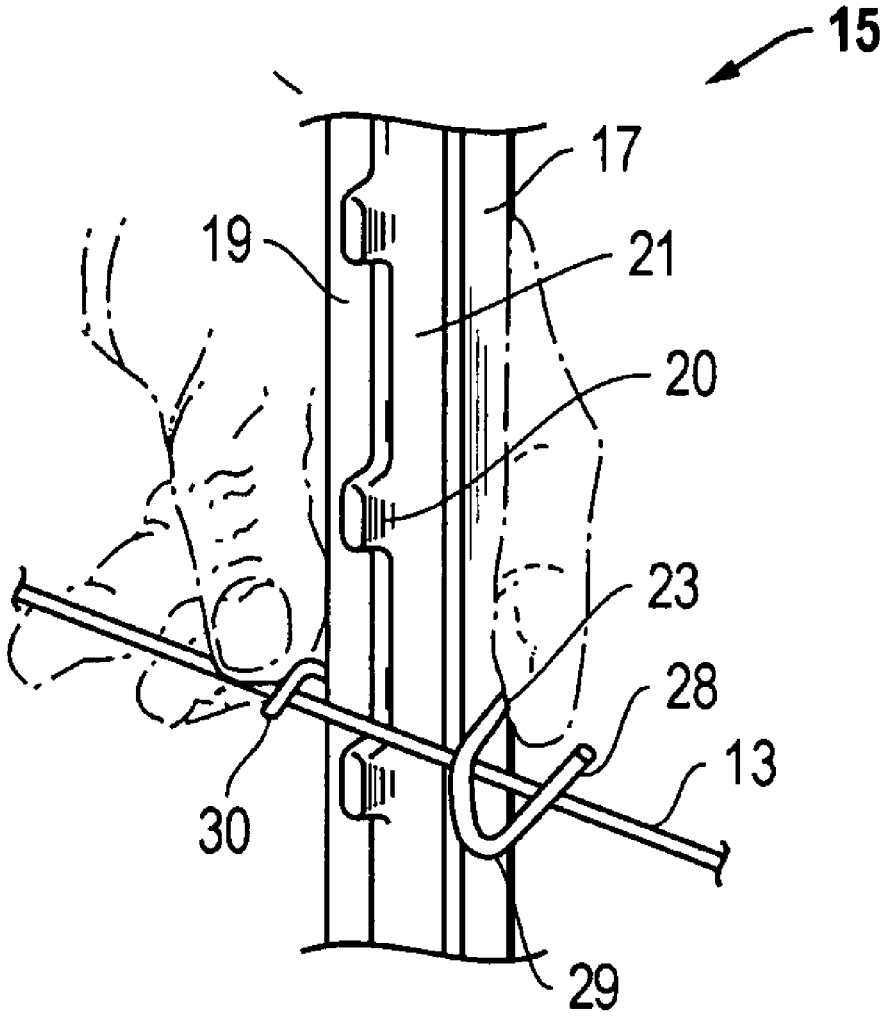
FIG. 1 (Prior Art)
FIG. 1 is an isometric view of a conventional fence post, fence wire, and mounting clip showing an initial positioning of the mounting clip.

Referring to FIG. 1, a conventional metal fence post 15 has a generally T-shaped cross-section formed by a center section 17 and side (e.g., left and right) opposing sections 19, 21, that are transverse to center section 17. A plurality of nubs 20 extend longitudinally down an exterior surface of the fence post 15. The fencing tool 151 (FIGS. 2–9) of the present invention is used to deform conventional mounting clips 23 to secure fence wire 13 to fence posts 15.

Figure 4:
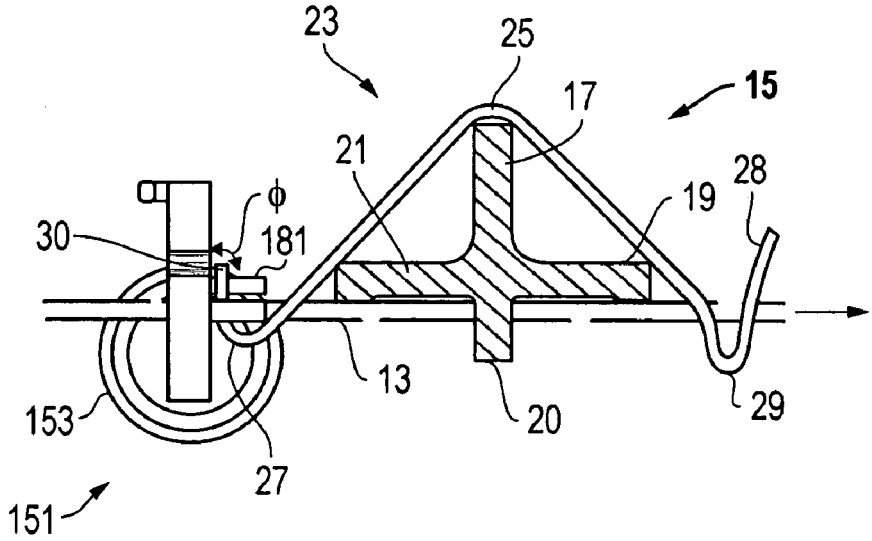
FIG. 4 is a top sectional view of a fence post and fence wire showing a mounting clip positioned thereon prior to deformation, and the fencing tool of FIG. 2.

As shown in FIG. 4, the stiff metal mounting clip 23 has a generally V-shaped central portion 25 that terminates in a pair of oppositely extending loops 27, 29. The V-shaped central portion 25 receives the center section 17 of the fence post 15 with the oppositely extending loops 27, 29 passing over and about the fence wire 13 that is being attached to the fence post 15. In the embodiment shown, the clip 23 has one end 28 that flares upwardly in an opposite direction from an opposite end 30 thereof. The end 30 passes back under the fence wire 13 in the initial position while the end 28 flares upwardly on the wire side of the fence post 15. For ease of reference, loop 29 and end 28 may be collectively referred to as "an end" or "end 28," and the loop 27 and end 30 may be collectively referred to as "an end" or "the end 30."

Figure 2:
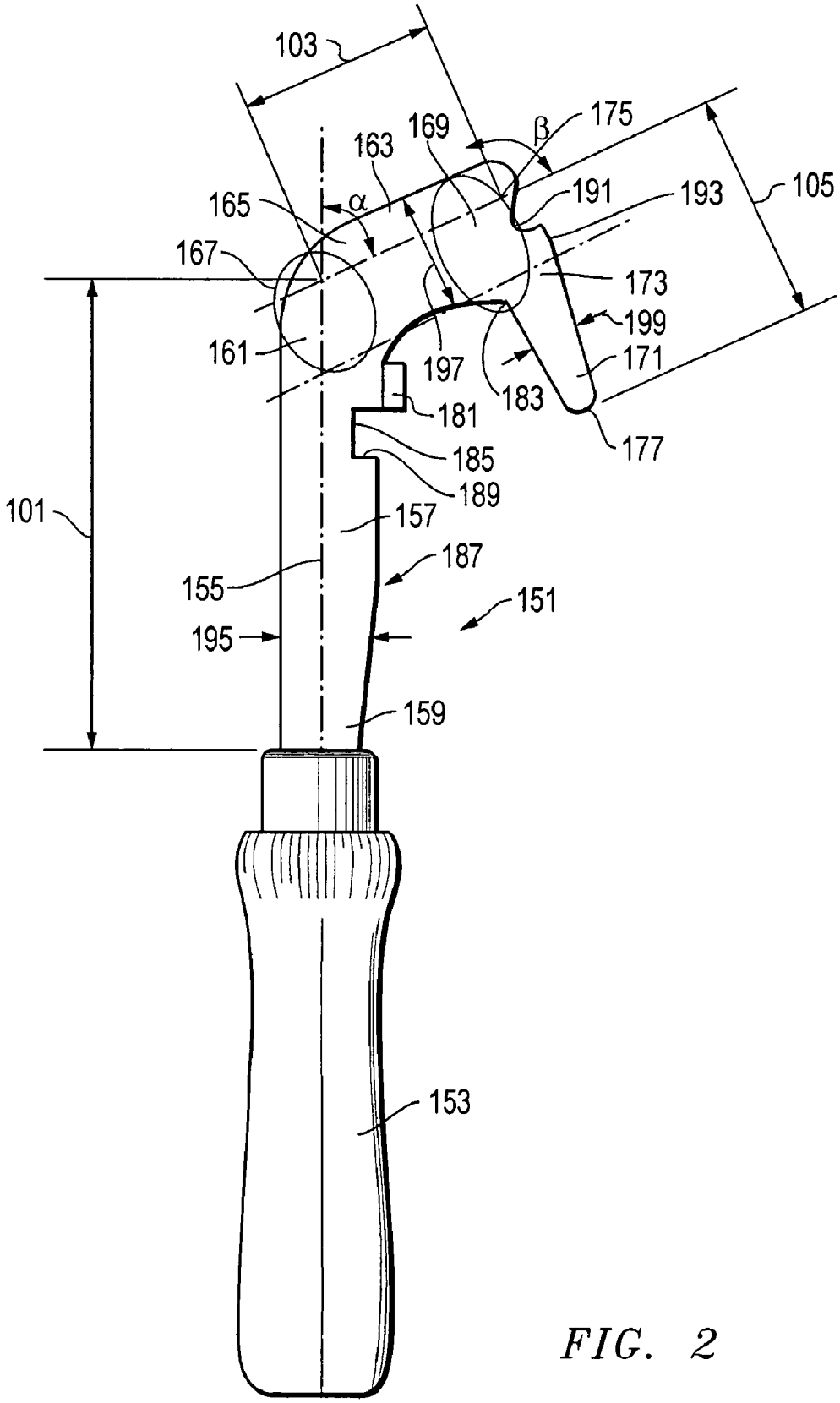
FIG. 2 is a side view of one embodiment of a fencing tool constructed in accordance with the present invention.
Figure 3:
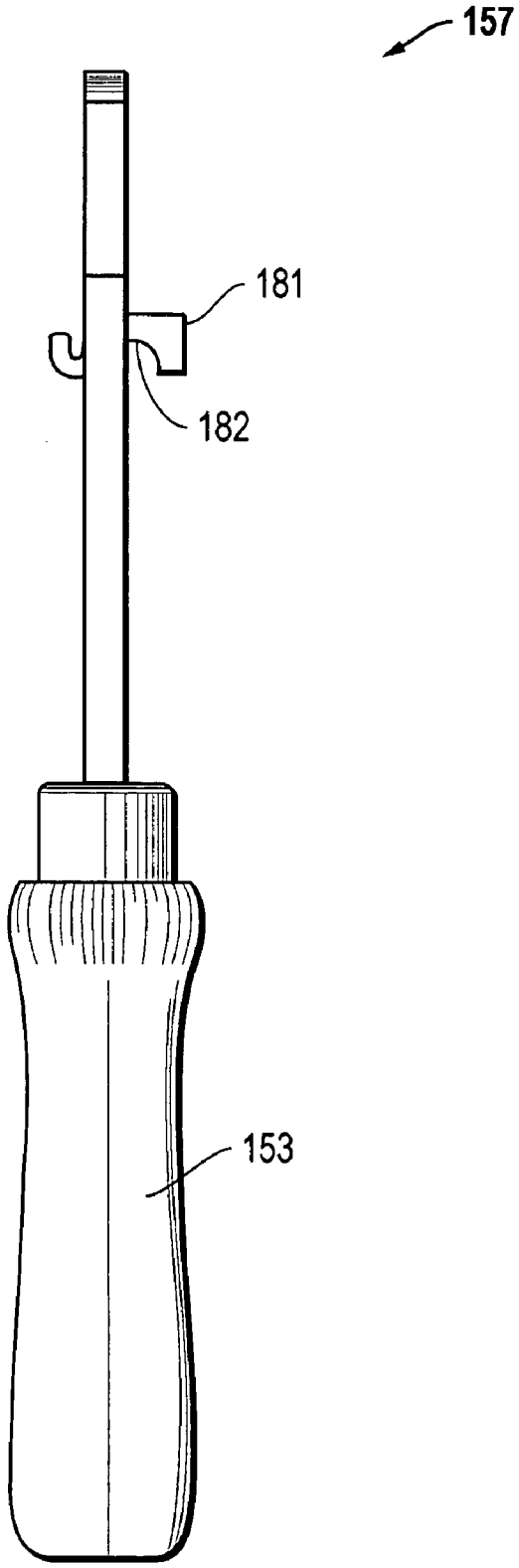
FIG. 3 is a rear view of the fencing tool of FIG. 2.

Referring now to FIGS. 2 and 3, one embodiment of fencing tool 151 constructed in accordance with the present invention is shown. Tool 151 is used to secure the fence wire 13 to the fence post 15 with the mounting clip 23. Tool 151 has a handle 153 (e.g., contoured wood) with an axis 155. A rigid flat body 157 (e.g., metal) extends in a generally axial direction from the handle 153. The body 157 has a body proximal end 159 located adjacent to the handle 153, and a body distal end 161 located opposite the body proximal end 159.

An intermediate portion 163 extends from the body distal end 161 at an intermediate angle $\alpha$ with respect to the axis 155. The intermediate portion 163 has an intermediate proximal end 165 that forms a first intersection 167 with the body distal end 161, and an intermediate distal end 169 located opposite the intermediate proximal end 165. A terminal portion 171 extends from the intermediate distal end 169 at a terminal angle $\beta$, such that the terminal portion 171 is oriented in a different configuration than the intermediate portion 163 with respect to the body 157. In one embodiment, intermediate angle $\alpha$ is approximately 60°, and terminal angle $\beta$ is 90°. The terminal portion 171 has a terminal proximal end 173 that forms a second intersection 175 with the intermediate distal end 169, and a terminal distal end 177 that is opposite the terminal proximal end 173.

The tool 151 further comprises an appendage or finger 181 that extends sideways from the upper portion of body 157 near body distal end 161 toward portion 171, but at a finger angle $\phi$ (FIG. 4) relative to the plane defined by flat body 157. Finger 181 includes a small, semi-circular scallop 182 (approximately 1/16-inch in diameter) wherein the ends of the mounting clip 23 may be seated and positively retained during assembly. The finger 181 forms a very small rectangular flat "blade" that is perpendicular to the plane of body 157, and is parallel to axis 155 as shown in FIG. 2.

The body 157, the intermediate portion 163, and the terminal portion 171 are co-planar and define a continuous flat blade of, for example, 10 gauge steel (approximately 0.125 inches thick). Thus, tool 151 has a very slender profile that allow it to access even difficult-to-reach locations and positions. The finger 181 is generally rectangular and formed out of plane with respect to the continuous flat blade at finger angle $\phi$, which in one embodiment is approximately 90°. In the embodiment shown, finger 181 is the only portion of body 157 that extends out of plane with respect to body 157. There are no other protrusions from body 157 or the continuous flat blade that are out of the plane defined thereby.

Figure 6:
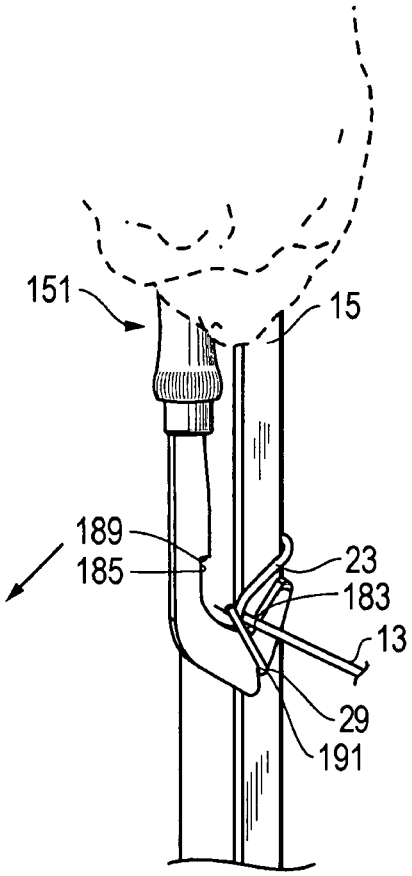
Figure 7:
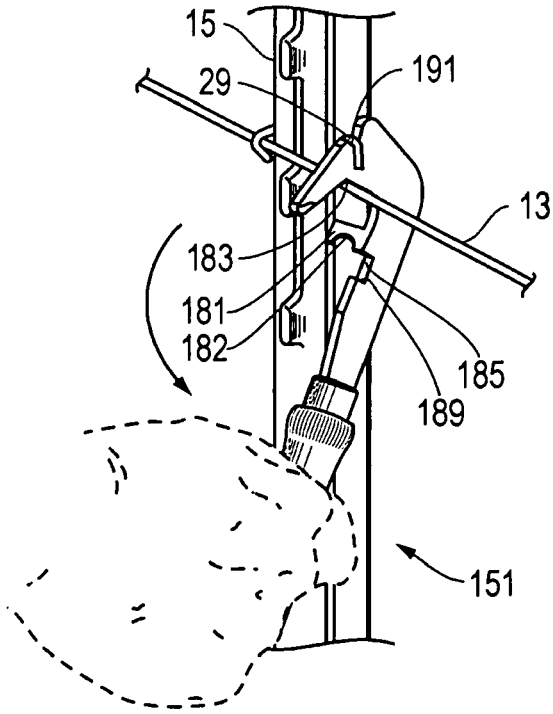
Figure 8:
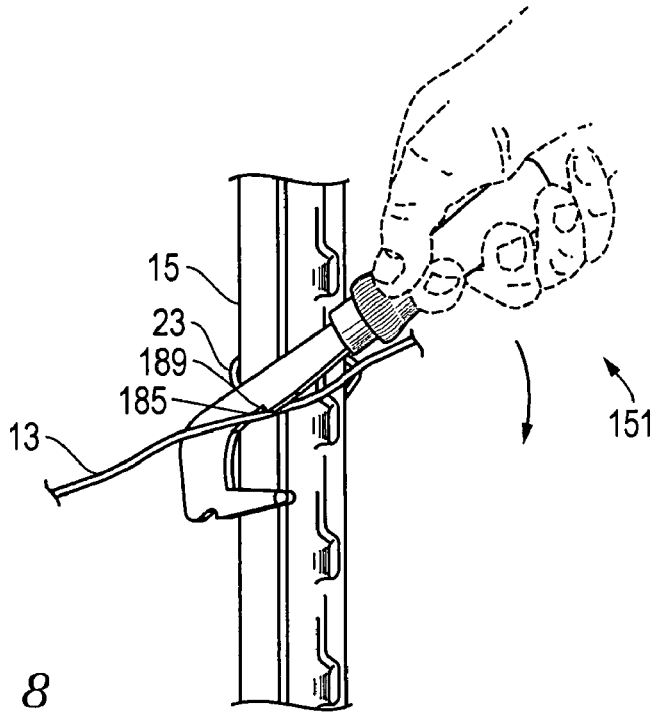
Figure 9:
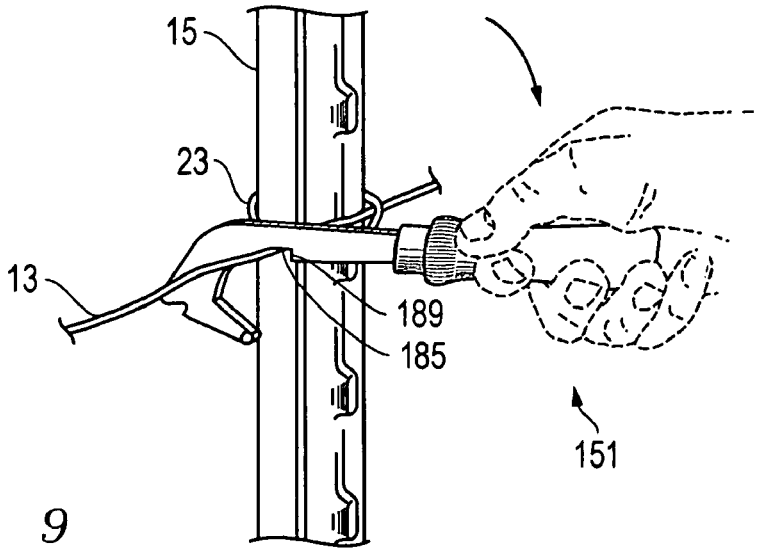
Figure 10:
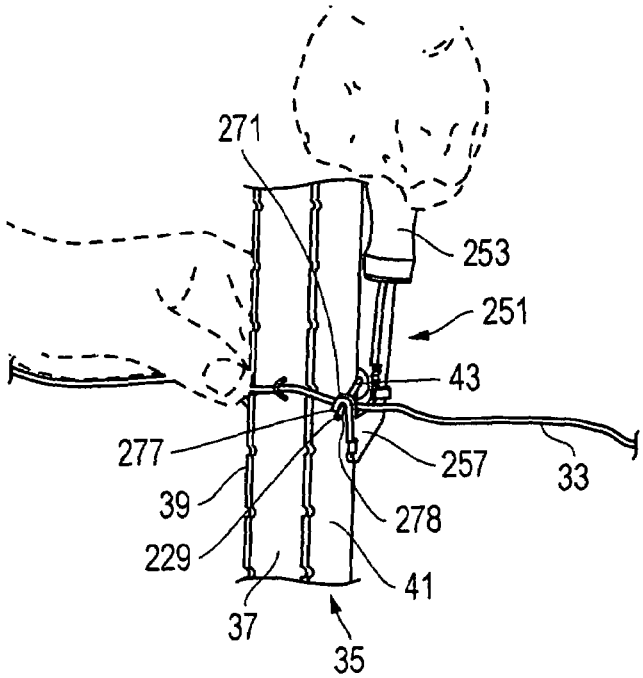
FIGS. 10–17 are various views showing the sequential operational steps of use of another embodiment of a fencing tool constructed in accordance with the invention, and is shown installing both sides of a mounting clip on a fence wire and a square electrical fence post.
Figure 11:
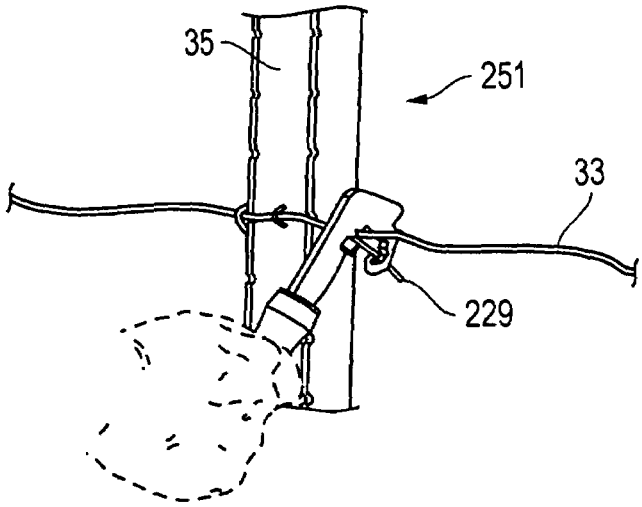
Figure 12:
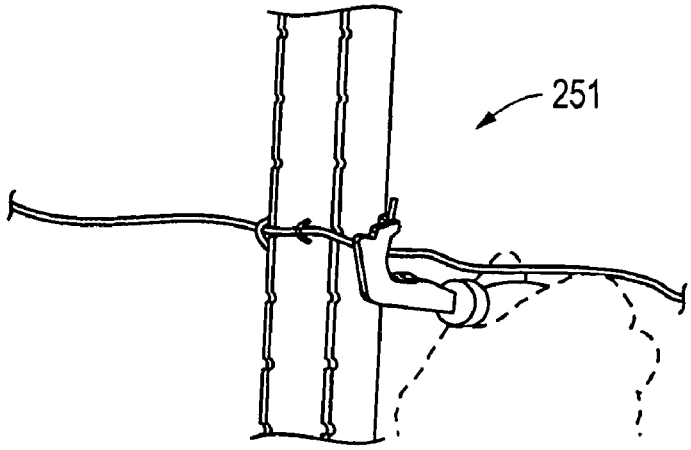
Figure 13:
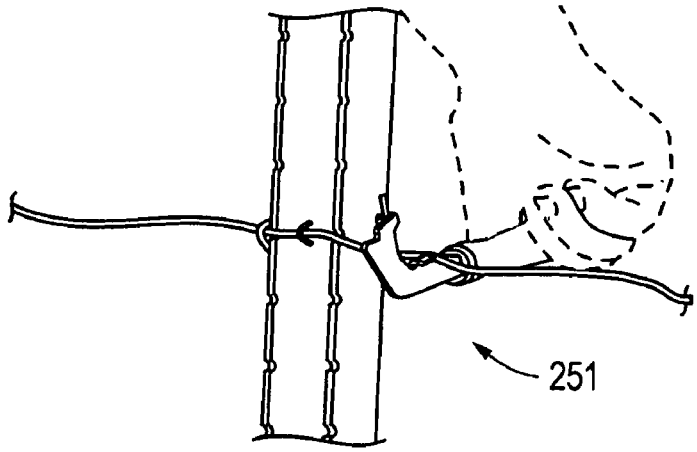
Figure 14:
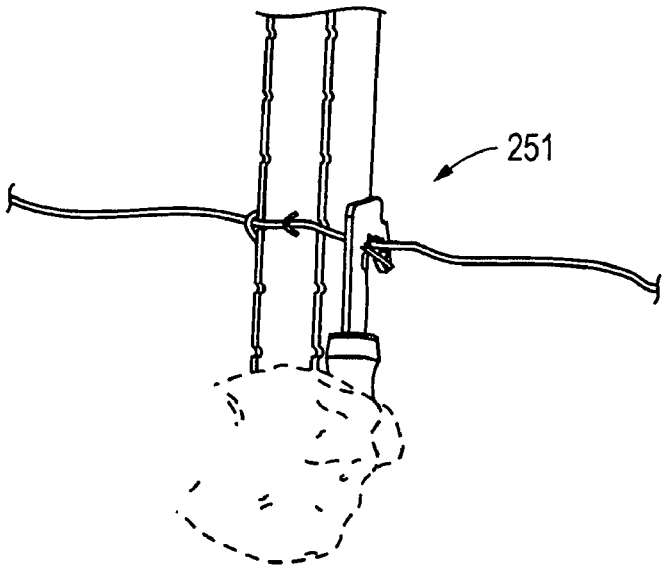
Figure 15:
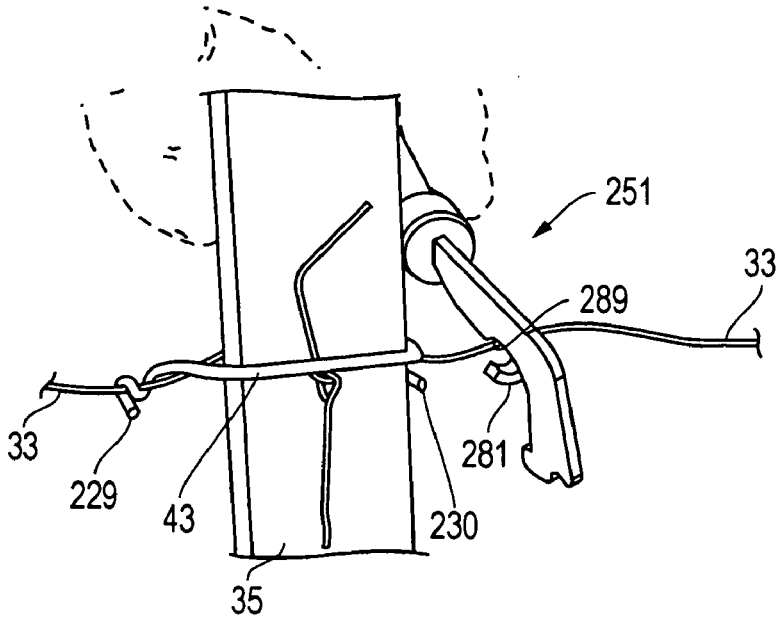
Figure 16:
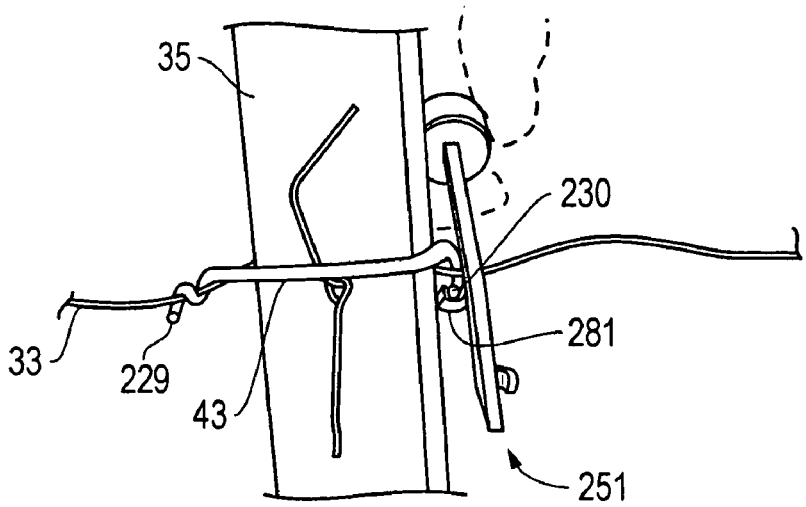
Figure 17:
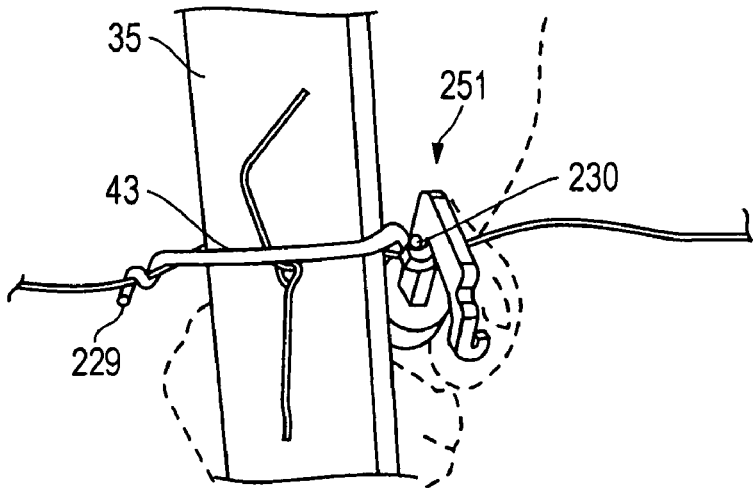

Body 157, portions 163, 171, and finger 181 are formed from a single, integral piece of thick flat metal. A first pocket 183 is formed between the terminal portion 171 and portion 163 for seating the fence wire 13 (FIGS. 6 and 7). A notch 185 having square shoulders forms a second pocket 189 (FIGS. 8 and 9) for seating the fence wire 13.

Figure 5:
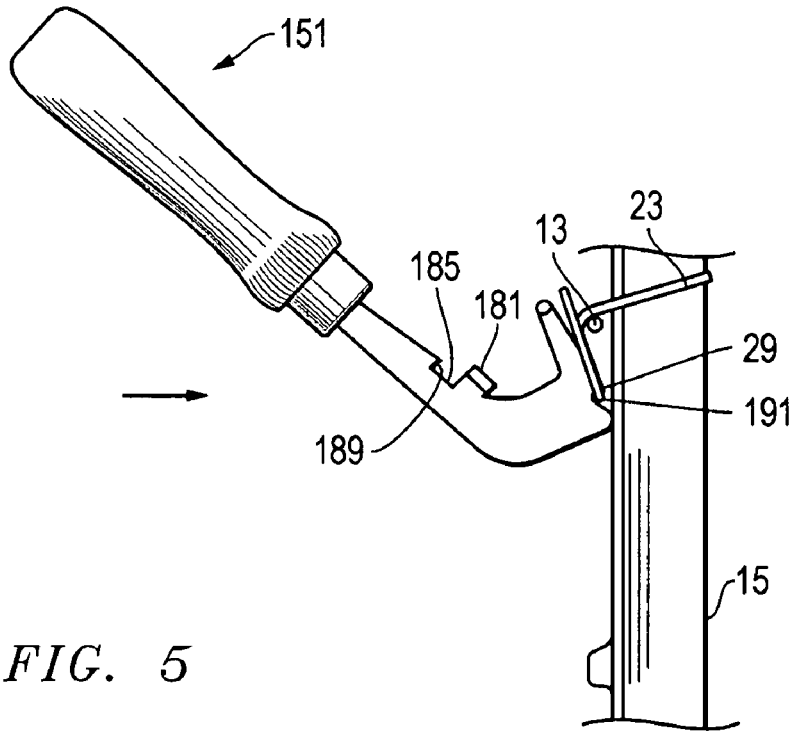
FIGS. 5–9 are various views showing the sequential operational steps of use of the fencing tool of FIG. 2 installing both sides of a mounting clip on a fence wire and a fence post.

The tool 151 also includes a concave recess 191 is formed in an outer edge 193 of the terminal portion 171 adjacent to the second intersection 175. The concave recess 191 has a radius of curvature that is adapted to receive a portion of a mounting clip 23 (FIGS. 5–7). The body 157 has a first width 195, the intermediate portion 163 has a second width 197 that is greater than the first width 195, and the terminal portion 171 has a third width 199 that is less than the first width 195. In addition, the body 157 has a first length 201, the intermediate portion 163 has a second length 203 that is less than the first length 201, and the terminal portion 171 has a third length 205 that is greater than the second length 203.

The present invention also comprises a method of securing a fence wire 13 to a fence post 15 with a mounting clip 23. One embodiment of the method comprises positioning a tool 151 on one side of the fence post 15 (FIGS. 5–7). The handle 153 should be oriented above the U-shaped body 157 and closer to the user than the body 157. As shown in FIG. 5, the method optionally first comprises pushing end 29 of the mounting clip 23 away from the user to slightly deform the mounting clip 23 into a better twisting position. In this step, the end 29 may be placed in recess 191 without tool 151 actually touching fence wire 13. As shown in FIG. 6, the method further comprises seating the fence wire 13 in a first pocket 183 in the tool 151, and one of the loops 29 in the recess 191 in the tool 151. The tool 151 is then rotated toward the user about the fence wire 13 (FIG. 7) in the first pocket 183 to bend said one of the loops 29 (and end 28) around the fence wire 13. In this step, the entire loop 29 is bent around the fence wire 13.

After the first loop 29 (e.g., right side in FIG. 7) of the mounting clip 23 is deformed, the tool 151 is disengaged from that side of the fence wire 13 and said one of the loops 29, and repositioned on the other side (e.g., left side in FIG. 8) of the fence post 15. This embodiment of the method further comprises seating the fence wire 13 in the second pocket 189 in the tool 151 and contacting the other end 30 with a finger 181 extending from the tool 151. The tool 151 is then rotated about the fence wire 13 (FIG. 9) in the second pocket 189 to bend said other end 30 around the fence wire 13. In this step, only the end 30 of the loop 28 is bent around the fence wire 13.

The method optionally comprises configuring the finger 181 out of plane with respect to a main body 157 of the tool 151, seating the fence wire 13 in a concave recess 191 formed on an outer edge 193 of the tool 151, and/or seating the fence wire 13 in a rectangular notch 189 formed on an inner edge 187 of the tool 151.

Referring now to FIGS. 10–17, another embodiment of a fencing tool 251 constructed in accordance with the invention is shown. This embodiment is substantially identical to the preceding embodiments, and is also well suited for installing both sides of a mounting clip 43 on a fence wire 33 and a square electrical fence post 35.

The major difference between tool 251 and tool 151 is that the terminal distal end forms a hook 277 on the terminal portion 271. Hook 277 is generally semi-circular and formed at at least 90 degrees from the planar surface of the body 257, and preferably in excess of 90 degrees for better retention of the mounting clip during installation operations. In one embodiment, at least one small rounded scallop or recess 278 is formed on the upper surface of hook 277 for improved performance. Tool 251 may be formed simply by bending the terminal portion 171 of tool 151 to form hook 277 on tool 251, in one embodiment. Hook 277 extends laterally from the body and curves outward and upward with respect to the body.

Thus, tool 251 has two "fingers" 277, 281 extending from its planar body at finger angles that are out of plane with respect to the continuous flat blade. No other portion of the body and continuous flat blade extends out of plane other than these two fingers. The two fingers extend in generally opposite directions on opposite sides of the body 257.

A conventional insulated electrical fence post 35 (FIG. 10) has a square shape formed by a center section 37 and side (e.g., left and right) opposing sections 39, 41, that are transverse to center section 37. A plurality of small notches 40 are formed along the edges of sections 39, 41 of the fence post 35.

As stated above, fencing tool 251 is used to deform conventional mounting clips 43 to secure fence wire 33 to fence posts 35. Tool 251 is positioned on one side of the fence post 35 (FIGS. 10–14). End 229 of mounting clip 43 is pulled toward (FIGS. 10–11), away from (FIGS. 12–13), and then again toward the user (FIG. 14) to deform the mounting clip 43. The end 229 is placed in recess 278 and seating the fence wire 33 against the inner edges of the tool body 257.

After the first end 229 of the mounting clip 43 is installed, the tool 251 is disengaged from that side of the fence wire 33, and repositioned on the other side (FIG. 15) of the fence post 35 to engage end 230. The fence wire 33 is seated in second pocket 289 in tool 251 and contacts end 230 with finger 281. Tool 251 is then rotated about the fence wire 33 (FIG. 17) to bend end 230 around the fence wire 33.

The present invention has several advantages, and is simple in design and economical to manufacture. The fencing tool has features, particularly the scallop in the finger, that facilitate grasping and exerting a bending force on a V-shaped mounting clip for installing a fence wire on a fence post. The curved edge regions of the tool exert cam forces on the fence wire to facilitate the bending movement of the mounting clip. Portions of the fencing tool act as a cam surface that engages and cooperate with the fence wire for applying a bending force to the mounting clip being mounted.

The present invention is a tie wrench for bending mounting clips to secure a fence wire to a fence post. Unlike prior art devices that are limited to use with wide-spaced barbed wire fencing, the tie wrench is small and has a very slender profile that make it ideal for fencing with more limited fence spacings. The tie wrench utilizes a hook that is positioned beneath the fence wire but above an outer portion of the mounting clip. The tie wrench is then pulled toward the user to twist the outer portion of the mounting clip into a position that secures one side of the mounting clip and the fence wire to the fence post.

The other side of the mounting clip is engaged and deformed in a similar manner by a flared finger that protrudes from the blade body of the tool at an inclined angle from the blade body. The large bend in the blade coupled with the small recess adjacent the exterior corner of the device seats the fence wire and produces a fencing tool that is easier and quicker to use compared to prior art devices. Unlike some conventional devices, no through-holes or apertures are required to be formed in the tool in order to engage and/or deform the mounting clip.

While the invention has been shown or described in only some of its forms, it should be apparent to those skilled in the art that it is not so limited, but is susceptible to various changes without departing from the scope of the invention.

What is claimed is:

1. A fencing tool, comprising:

a body having an axis, a body proximal end, and a body distal end located opposite the body proximal end;

an intermediate portion extending from the body distal end at an intermediate angle with respect to the axis, the intermediate portion having an intermediate proximal end that forms a first intersection with the body distal end, and an intermediate distal end located opposite the intermediate proximal end;

a terminal portion extending from the intermediate distal end at a terminal angle, such that the terminal portion is oriented in a different configuration than the intermediate portion with respect to the body, the terminal portion having a terminal proximal end that forms a second intersection with the intermediate distal end and a terminal distal end that is opposite the terminal proximal end;

the body, the intermediate portion, and the terminal portion are co-planar and define a continuous flat blade; and only two fingers extending from the body at finger angles that are out of plane with respect to the continuous flat blade, such that no other portion of the body and continuous flat blade extends out of plane other than said only two fingers.

2. The fencing tool of claim 1, further comprising a rounded recess formed on a surface of one of the two fingers for seating and positively retaining a mounting clip during assembly.

3. The fencing tool of claim 2, wherein said one of the two fingers is a hook and semi-circular in shape with respect to the continuous flat blade.

4. The fencing tool of claim 2, wherein said one of the two fingers extends laterally from the body and curves outward and upward with respect to the body.

5. The fencing tool of claim 1, wherein the two fingers extend in generally opposite directions on opposite sides of the body.

6. The fencing tool of claim 1, wherein the body has a first width, the intermediate portion has a second width that is greater than the first width, and the terminal portion has a third width that is less than the first width.

7. The fencing tool of claim 1, wherein the body has a first length, the intermediate portion has a second length that is less than the first length, and the terminal portion has a third length that is greater than the second length.

8. The fencing tool of claim 1, wherein the terminal distal end is radiused, and a pocket is formed between the terminal portion and the finger that is adapted to seat a fence wire.

9. A fencing tool for securing a fence wire to a fence post with a mounting clip, the mounting clip having a central portion that terminates in a pair of loops on opposite sides of the central portion, the fencing tool comprising:

a handle having an axis;

a body extending in a generally axial direction from the handle, the body having a body proximal end located adjacent to the handle and a body distal end located opposite the body proximal end;

an intermediate portion extending from the body distal end at an intermediate angle with respect to the axis, the intermediate portion having an intermediate proximal end that forms a first intersection with the body distal end, and an intermediate distal end located opposite the intermediate proximal end;

a terminal portion extending from the intermediate distal end at a terminal angle, such that the terminal portion is oriented in a different configuration than the intermediate portion with respect to the body, the terminal portion having a terminal proximal end that forms a second intersection with the intermediate distal end and a terminal distal end that is opposite the terminal proximal end;

the body, the intermediate portion, and the terminal portion are co-planar and define a continuous flat blade, and a first finger extending from the body at a finger angle that is out of plane with respect to the continuous flat blade, the first finger having a rounded recess formed on a surface thereof for seating and positively retaining a mounting clip during assembly to form a hook that is semi-circular in shape with respect to the continuous flat blade, the hook extending laterally from the body and curving outward and upward with respect to the body.

10. The fencing tool of claim 9, further comprising a second finger extending from the body at a perpendicular angle relative and being rectangular in shape, and the second finger is out of plane with respect to the continuous flat blade;

a scallop formed in the second finger for seating and positively retaining a mounting clip during assembly, the scallop being semi-circular and having a diameter of approximately 1/16-inch; and a first pocket is formed between the intermediate and terminal portions for seating the fence wire.

11. The fencing tool of claim 9, further comprising a concave recess formed in an outer edge of the terminal portion adjacent to the second intersection, the concave recess having a radius of curvature that is adapted to receive a portion of a mounting clip.

12. The fencing tool of claim 9, wherein the intermediate angle is approximately 60°, the terminal angle is approximately 90°, and the finger angle is approximately 90°.

13. The fencing tool of claim 8, wherein the body has a first width, the intermediate portion has a second width that is greater than the first width, and the terminal portion has a third width that is less than the first width; and wherein the body has a first length, the intermediate portion has a second length that is less than the first length, and the terminal portion has a third length that is greater than the second length.

14. The fencing tool of claim 10, wherein the second finger protrudes toward the terminal portion, and the second pocket is located on an interior edge of the body adjacent to the second finger.

15. The fencing tool of claim 10, wherein the second finger protrudes away from the terminal portion, and the second pocket is located on an exterior edge of the body adjacent to the second finger such that the second pocket also protrudes away from the terminal portion.

* * * * *